United States Patent [19]

Akizawa et al.

[11] Patent Number: 5,009,355

[45] Date of Patent: Apr. 23, 1991

[54] ELECTRIC STAPLER

[75] Inventors: Nobuyuki Akizawa; Yasunori Kudo; Toshiyuki Kanai; Yasuo Kamei; Nobuaki Oyama; Akihito Negishi, all of Tokyo, Japan

[73] Assignee: Max Co., Ltd., Tokyo, Japan

[21] Appl. No.: 504,032

[22] Filed: Apr. 2, 1990

Related U.S. Application Data

[63] Continuation-in-part of Ser. No. 291,221, Dec. 28, 1988, abandoned.

[30] Foreign Application Priority Data

| | | | |
|---|---|---|---|
| Dec. 28, 1987 | [JP] | Japan | 62-198839[U] |
| Jan. 26, 1988 | [JP] | Japan | 63-8544[U] |
| Apr. 21, 1988 | [JP] | Japan | 63-54047[U] |
| Apr. 21, 1988 | [JP] | Japan | 63-54049[U] |

[51] Int. Cl.[5] ..... B27F 7/17

[52] U.S. Cl. ..... 227/114; 227/85; 227/131; 227/155

[58] Field of Search ..... 227/155, 131, 139, 120, 227/123, 82–90, 95, 45, 48

[56] References Cited

U.S. PATENT DOCUMENTS

| | | | |
|---|---|---|---|
| 1,956,174 | 4/1934 | Maynard | 227/155 |
| 3,613,217 | 10/1971 | Perkins | 227/155 X |
| 4,199,095 | 4/1980 | Yamanoi | 227/120 X |
| 4,315,589 | 2/1982 | Soong | 227/155 |
| 4,344,554 | 8/1982 | Cross | 227/155 X |
| 4,593,847 | 6/1986 | Hagemann | 227/155 |
| 4,623,082 | 11/1986 | Kurosawa | 227/120 X |
| 4,641,772 | 2/1987 | Skuthan | 227/123 |

*Primary Examiner*—Douglas D. Watts
*Assistant Examiner*—Rinaldi Rada
*Attorney, Agent, or Firm*—Cushman, Darby & Cushman

[57] ABSTRACT

An electric stapler including tension springs which prevent a second staple from entering a staple supply position of a magazine when a first staple is jammed therein. The tension springs are connected between the arm of actuating links and connecting rods. The connecting rods connect the actuating links to the shaft of a motor. A clincher is provided which folds the legs of a U-shaped staple which have penetrated an article to be stapled against the article.

7 Claims, 6 Drawing Sheets

ELECTRIC STAPLER

This a continuation of application Ser. No. 07/291,221, filed Dec. 28, 1988 now abandoned.

BACKGROUND OF THE INVENTION

This invention relates to a power-driven stapler for performing stapling operations and more particularly to a power-driven stapler in which unformed staple elements are automatically fed successively by a power motor to a staple forming and driving unit so that each staple element is formed into a U-shaped staple and then is driven through an article to be stapled.

The type of power-driven or electrically-actuated stapler in which each unformed staple element is formed into a U-shaped staple and then is driven through an article such as sheets of paper is disclosed in U.S. Pat. No. 4,623,082, owned by the assignee of the present invention. Such conventional electric stapler employs an electric motor as drive means and actuating links which are driven by the motor. A staple forming and driving unit connected to one end of the actuating links through respective springs as well as a magazine are vertically moved so as to drive each staple through the article to be stapled. A predetermined number of unform staple elements are adhesively bonded together in the form of a sheet, and a plurality of such sheets are stacked one upon another within a staple cartridge. The stack of staple element sheets are sequentially fed toward the staple forming and driving unit by an endless belt serving as a staple feeder, with the lowermost sheet being fed out first, so that each staple element is formed into a U-shape and then driven through the article to be stapled. Then, the legs of the U-shaped staple extending through the work are folded by a clinching means.

The actuating links are pivotally mounted on a base of the stapler intermediate opposite ends thereof, and have a first end engaged with the magazine. A motor-driven cam plate acts on the second end of the actuating links so that the magazine is moved vertically, that is, upwardly and downwardly. When it is desired to increase the stroke of the vertical movement of the magazine to increase an insertion opening for insertion of the article to facilitate the insertion of the article in its stapling position, in this conventional construction, the stroke of the vertical movement of the second end of the actuating links needs to be correspondingly increased. As a result, the overall size of the stapler becomes large. To provide an overall compact construction of the stapler, it is necessary to either shorten the actuating links or decrease the size of the cam plate. However, if the actuating links are reduced in length, the cam plate needs to be larger, so that the eccentricity of the cam plate is correspondingly increased. On the other hand, of the cam plate is reduced in size, then the actuating links need be increased in length. Therefore, with these procedures, it has been difficult to provide a compact stapler.

Another dificulty with the above conventional stapler is that the staple forming and driving unit is forcibly returned to its upper dead point (i.e,. initial position) in accordance with the movement of the actuating links, so that even if a staple is jammed in a staple driver guide path, subsequent staples are sequentially fed to this driver guide path so long as the motor continues to rotate to actuate the actuating links. Thus, in the above conventional electric stapler, once a staple becomes jammed in the driver guide path, subsequent staples also become jammed successively, and the staples thus jammed and deformed give rise to damage to the driver guide path thereby preventing the proper movement of the stapler, and holding the staple driver against movement in the driver guide path which stops the rotation of the motor in its energized condition.

In conventional staplers of the type in which sheet-like staple elements are fed by an endless belt to the staple forming and driving unit from the staple cartridge, where a space or distance between an upper surface of the endless belt and a lower surface of a staple guide portion of the staple cartridge is almost equal to the thickness of the sheet-like staple element. The force under which the sheet of staple elements is urged against the upper surface of the endless belt is weak, and therefore the staple feed force is also weak. This may result in failure to properly feed the sheet of staple elements. If the above space between the upper surface of the endless belt and the lower surface of the guide portion is less than a half of the thickness of the sheet of staple elements, the sheet can not be discharged from the staple cartridge, thus failing to properly feed the sheet of staple elements. To overcome this difficulty, it has been necessary to keep the space between the upper surface of the endless belt and the lower surface of the guide portion in a range wherein at the low end the space is less than the thickness of the sheet of staple elements and at the high end more than half of this thickness. This requires high processing or machining precision.

U.S. Pat. No. 4,593,847 discloses a typical example of clincher devices of the type in which a pair of legs of a stapler extending through an article to be stapled are folded or bent against the back side of the article in parallel relation to each other. In such a clincher device, movable clincher members for pressing the staple legs against the back side of the article have recesses or grooves for receiving the staple legs. Therefore, the staple legs fail to be firmly pressed against the article at a final portion of the clinching operation, so that the folded or clinched staple legs are spaced from the back side of the article, which results in a relatively loose stapling.

SUMMARY OF THE INVENTION

It is therefore an object of this invention to provide an electric stapler which is compact in size and can be smoothly driven by a motor.

Another object is to provide such a stapler in which when a staple is jammed in a staple driver guide path, subsequent staples are prevented from entering the staple driver guide path.

A further object is to provide a staple supply mechanism which can hold a number of staple elements in a limited space and can automatically feed the staple elements successively.

A still further object is to provide a clincher device capable of folding staple legs against the back side of an article to be stapled in parallel relation.

According to the present invention, there is provided an electric stapler comprising a base and a magazine pivotally mounted on the base for vertical movement. The magazine includes a cartridge mounting portion for mounting a staple cartridge having an accommodating portion for containing a stack of staple sheets. A staple feed path means extends from the accommodating portion to a staple supply position. An endless belt disposed below the cartridge and having an outer friction surface for engagement with the staple within the acccommodating portion so as to feed it along the staple feed path means to the staple supply position is also included in the magazine. A staple driver guide path means disposed generally perpendicular to the staple feed path means and passing through the staple supply position; and a staple driver for reciprocal movement along the driver guide path means so as to drive the staple, fed to the staple supply position, through a work to be stapled are also provided in the magazine.

The stapler further includes an actuating link having one end engaged to a staple forming and driving unit 5 which is movable relative to the magazine, and the other end pivotally mounted on the base. A drive shaft for feeding staple sheet is mounted on the base and is operable by a motor for rotation about its axis. A disc-shaped cam member is fixedly mounted on a drive shaft in eccentric relation thereto for rotation therewith. A connecting rod at one end of an annular portion in which the cam member is rotatably fitted so as to vertically move the connecting rod is provided. The connecting rod has a central portion which is connected to a central portion of the actuating link to pivotally move the link. Clinching means is provided for folding the legs of the staple extending through the article against it.

The electric stapler is driven by a small-size motor which requires no instantaneous high consumption of electric current and generates no large impact operation sound, and in which one cycle of stapling operation is carried out per one rotation of a final gear included in a speed reduction gear train for reducing the rotation speed of the motor. The connecting rod operatively connected to the motor-actuated drive shaft through the eccentric cam member is connected to the central portion of the actuating link to drive the actuating link. This arrangement achieves a compact overall construction of the electric stapler.

The lower surface of the guide portion extending from the discharge port portion of the cartridge accommodating portion is stepped, so that the staple sheet can be fed by the endless belt.

A final portion of the return stroke of the staple driver is effected by the resilient urging means. With this construction, if one staple becomes jammed in the driver guide path means, the staple driver can not be moved by the resilient urging means upwardly beyond the staple supply position. This prevents subsequent staples from entering into the driver guide path means, thereby preventing damage thereto.

The clincher device has a pair of movable clincher members having respective active flat surfaces for engagement with a pair of legs of a U-shaped staple. Therefore, the staples legs are folded against the article.

BRIEF DESCRIPTION OF THE DRAWINGS

FIG. 1(*b*) is a side-elevational view of the electric stapler in accordance with the present invention in a stapling position.

FIG. 3(*b*) is a side-elevational view of the electric stapler in accordance with the present invention.

DESCRIPTION OF THE PREFERRED EMBODIMENT OF THE INVENTION

The invention will now be described with reference to the figures in which like references represent like parts throughout.

Figure 1A:
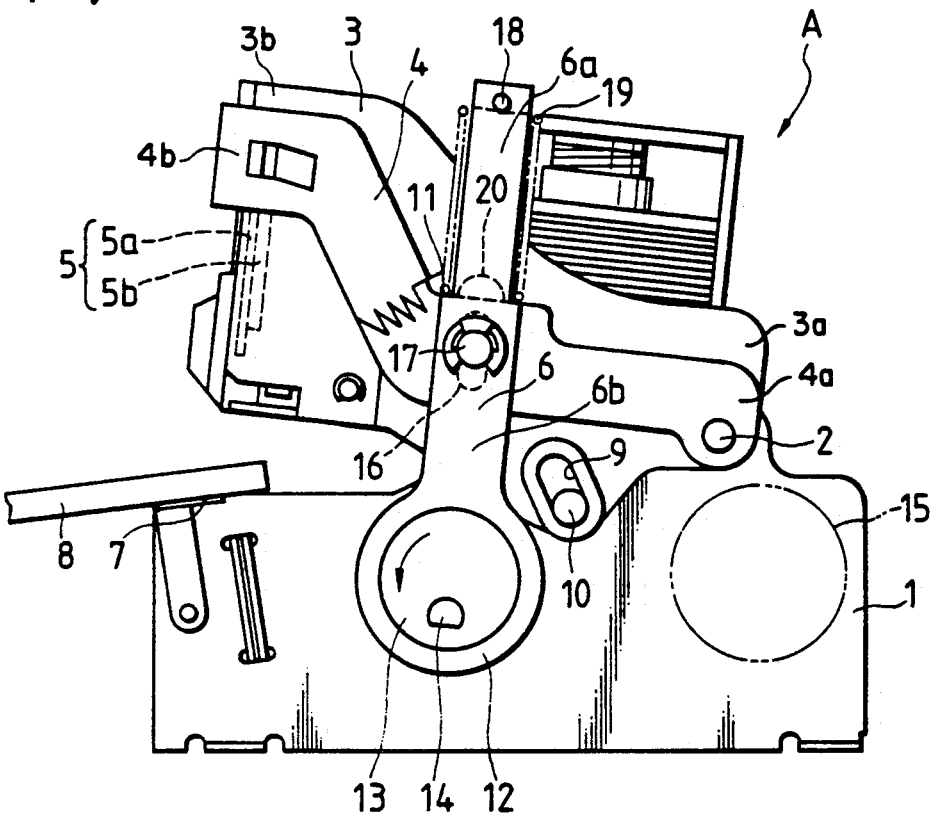
FIG. 1(*a*) is a side-elevational view of the electric stapler provided in accordance with the present invention in an unstapling position.
Figure 1B:
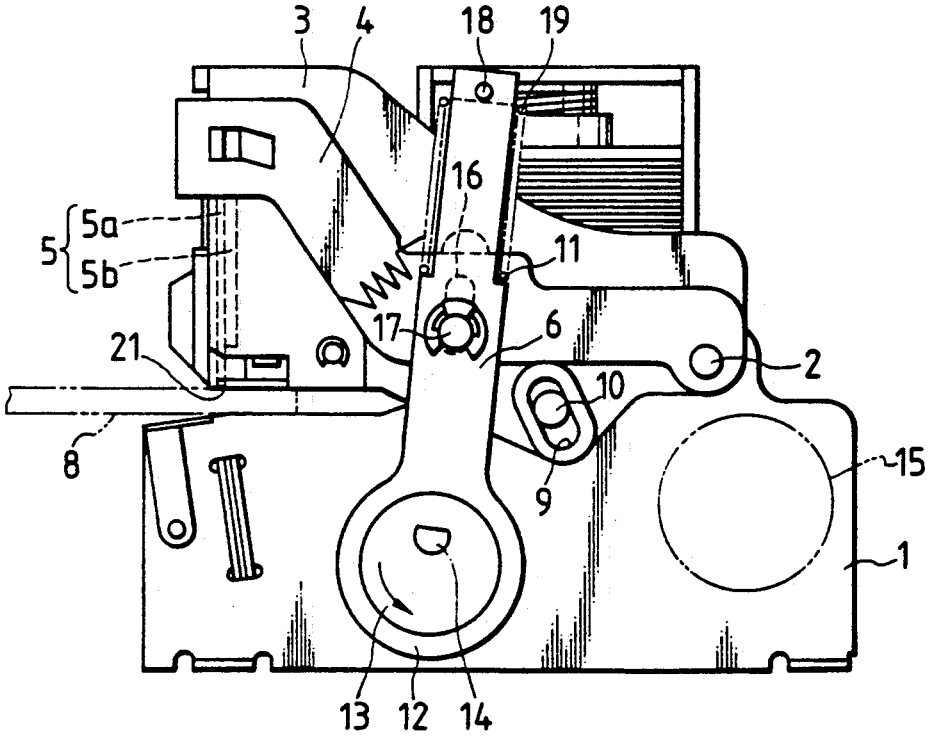
Figure 2:
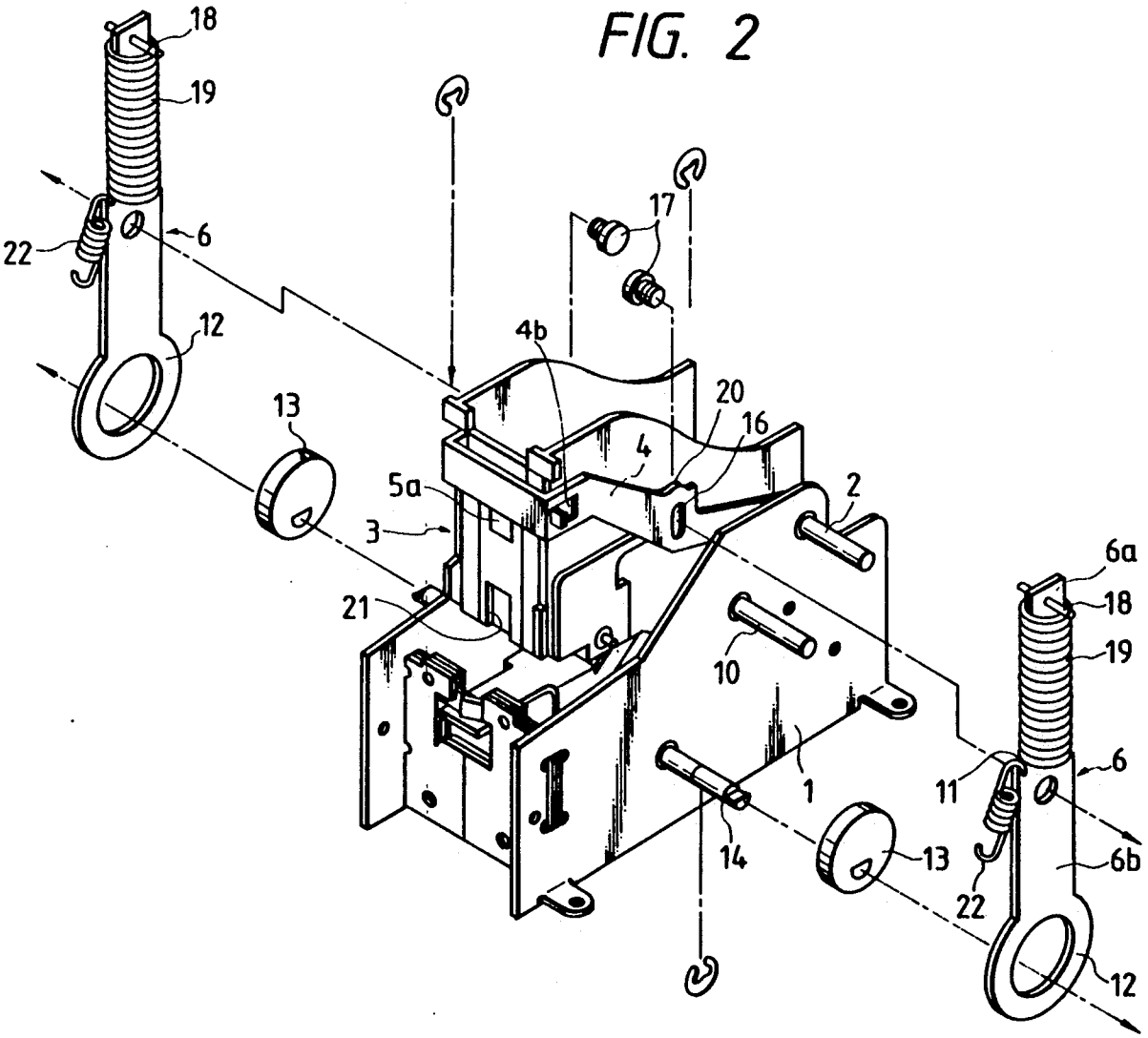
FIG. 2 is a partially exploded, perspective view of the electric stapler in accordance with the present invention.

Referring to FIGS. 1(*a*), 1(*b*) and 2, reference character A denotes an electric stapler according to the invention. A magazine 3 and an actuating link 4 are pivotally mounted at their first ends 4*a* and 3*a* respectively on a support shaft 2 mounted on a base 1. The second end 4*b* of the actuating link 4 is engaged with a staple forming and driving unit 5 mounted on the second end 3*b* of the magazine 3. The unit 5 has a vertically movable staple driver 5*a* and a forming member 5*b*. The driving unit 5 can be suitable staple driving unit as will be readily appreciated by the ordinary artisan. For example, a driving unit similar to that disclosed in U.S. Pat. No. 4,623,082 may be provided wherein staple driver 5*a* correspondence to driver 46 and forming member 5*b* corresponds to forming plate 34, 47. A pair of connecting rods 6 are disposed on opposite sides of the magazine 3 so that when the connecting rods 6 are vertically moved, the magazine 3 is vertically moved together with the actuating link 4 to drive the staple forming and driving unit 5 so as to staple an article 8 placed on a staple table 7 provided at a front end of the base 1.

An engaging slot 9 is provided at a lower portion of the magazine 3, and a connecting shaft 10 mounted on the base 1 is loosely fitted in the engaging slot 9 for movement there along. The upward movement of the magazine 3 is limited by engagement of the connecting shaft 10 with the lower end of the slot 9.

The connecting rods 6 are connected to the actuating link 4 in intersecting relation thereto. Each connecting rod 6 has a stepped portion of shoulder 11 disposed between an upper portion 6*a* and an intermediate portion 6*b*, and an annular lower end portion 12. A cam member 13 having a disc shape is rotatably fitted in the annular portion 12 of each connecting rod 6 so that the rotation of the cam member 12 causes the connecting rod 6 to move vertically, that is, upwardly and downwardly.

The pair of disc-shaped cam members 13 are fixedly mounted in an eccentric manner respectively on opposite ends of a drive shaft 14 mounted on the base 1 and extending outwardly from the opposite sides of the base 1. The drive shaft 14 is connected to a motor 15 via a speed reduction device (not shown).

The actuating link 4 has a generally vertically-disposed slot 16 formed through the central portion of each of the opposed arms thereof. A threaded pin 17 is loosely fitted in each slot 16 for movement therealong and is secured to the intermediate portion 6b of the connecting rod 6. Thus, each of the connecting rods 6 are loosely connected to the actuating link 4. Alternatively, slot 16 may be formed through the connecting rod 6, and the pin 17 may be secured to the actuating link 4.

A spring retaining pin 18 is mounted on the upper end of each connecting rod 6, and a compression coil spring 19 is wound around the connecting rod 6 and acts between the spring retainer pin 18 and the stepped portion 11.

When the stapling operation is to be carried out with the electric stapler A, a motor 15 causes the drive shaft 14 to make one rotation. When the drive shaft 14 rotates, the cam members 13 are rotated to move the connecting rods 6 downward, so that the lower end of each compression spring 19 is engaged with a spring receiving portion 20, formed on the upper edge of each arm of the actuating link 4 at the central portion thereof, to urge the link 4 downwardly. As a result, the second end 4b of the actuating link 4 is moved downward, and at the same time, the second end 3b of the magazine 3 is also moved downward. Then, when a staple outlet portion 21 provided at the front lower portion of the magazine 3 is brought into engagement with the article 8 on the staple table 7, the downward movement of the magazine 3 is stopped, but each connecting rod 6 continues to move to its lower dead point. Therefore, the compression spring 19 is further compressed to further move the actuating link 4 downward under the force of the biased compression spring 19, and the staple driver 5a of the staple forming and driving unit 5 connected to the actuating link 4 drives a staple (not shown), loaded into the magazine 3, through the article 8 to effect a stapling operation as shown in FIG. 1(*b*).

After the stapling operation is completed, each connecting rod 6 is returned or moved upward to its initial position, i.e., its upper dead point. Therefore, the spring force of the compression spring 19 is gradually decreased, and the pin 17 is brought into engagement with the upper end of the slot 16 of the actuating link 4 so that the actuating link 4 is returned upward to its upper dead point.

Figure 3A:
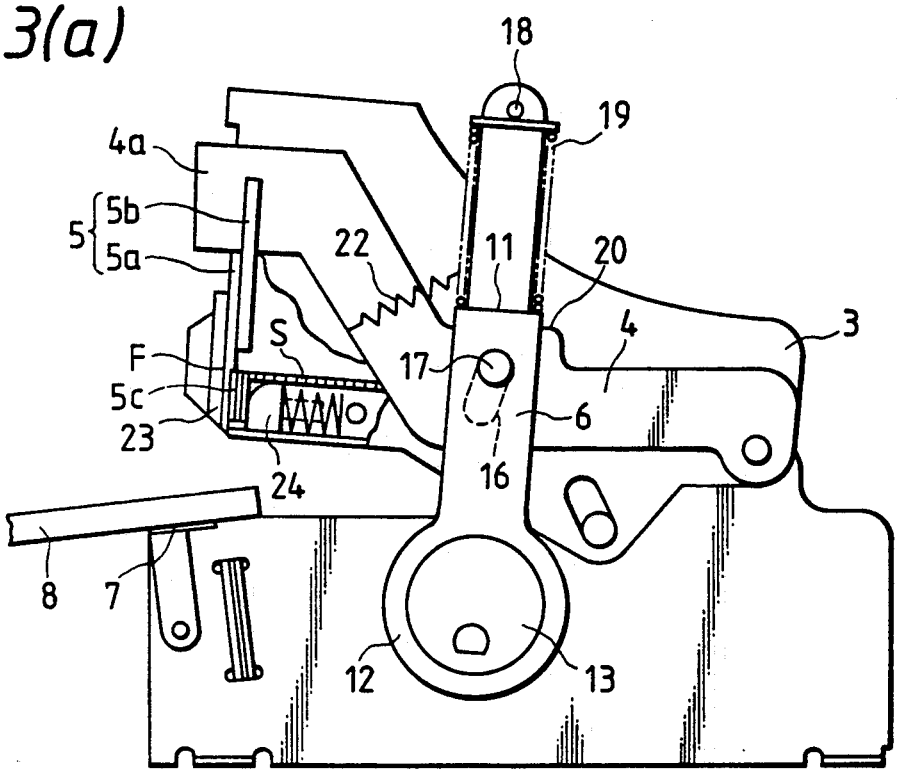
FIG. 3(*a*) is a side-elevational view of the electric stapler in accordance with the present invention.
Figure 3B:
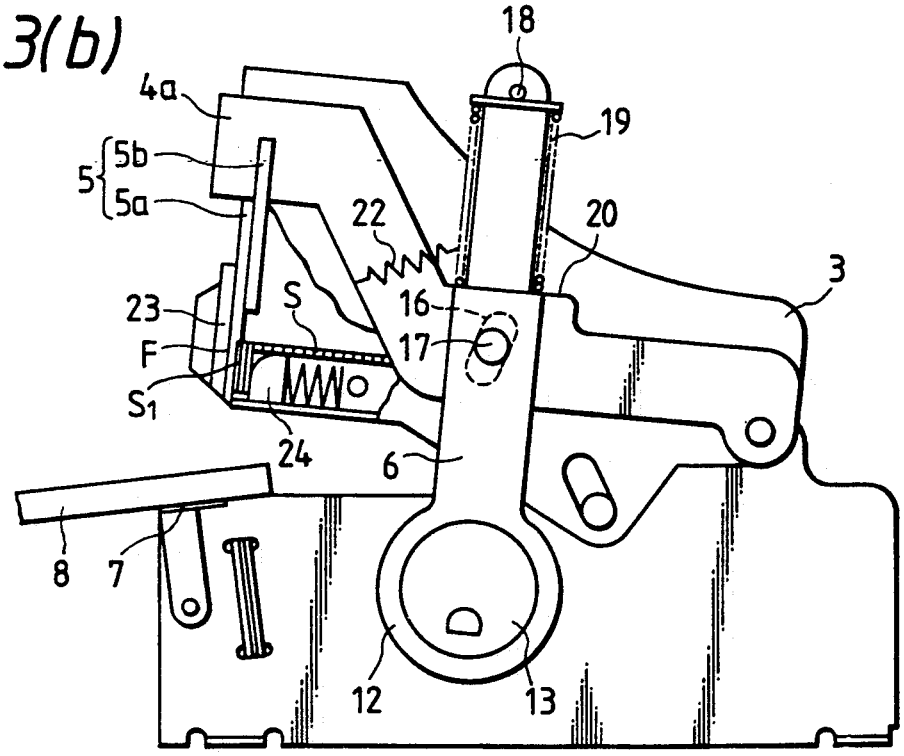

As best shown in FIGS. 3(*a*) and 3(*b*), a tension spring 22 acts between the arm of the actuating link 4 and each connecting rod 6. The tension spring 22 serves to further upwardly move the lower end 5c of the staple driver 5a beyond a predetermined position F in a driver guide path 23, i.e., a staple supply position, after the lower end 5c is returned to this predetermined position F by the movement of the connecting rod 6 through the actuating link 4.

The tension spring 22 has tension enough to return the actuating link 4 to a drive initiating position when the driver 5a is returned to the predetermined position F.

The staple driver 5a is engaged with the front end 4b of the actuating link 4 so as to be vertically movable reciprocally together with the actuating link 4 to drive the staple, fed into the driver guide path 23, toward the staple table 7. In addition to the staple forming and driving unit 5 for forming and driving the staple S, the magazine 3 includes a pusher 24 for feeding the staple S into the driver guide path 23. Again, the manner in which the actuating link 4 and the staple driver 5a are coupled so as to be movable reciprocally together would be readily appreciated by the ordinary artisan and does not, in particular, form a part of this invention. A suitable interconnection between these members is taught in U.S. Pat. No. 4,623,082 as is a suitable pusher and staple feed path.

When the motor 15 is driven for rotation, with the article 8 placed on the staple table 7, the driver 5a is moved downward together with the actuating link 4 by the motion converting mechanism, comprising the cam members 13 and the connecting rods 6 through the compression springs 19. As a result, the staple S, fed into the driver guide path 23 of the magazine 3, is driven by the driver 5a downwardly to be extended through the article 8 to effect a stapling operation.

When the motor 15 is further rotated after the stapling operation is completed, each connecting rod 6 is moved upward, so that the pin 17 of the connecting rod 6 is brought into engagement with the upper end of the slot 16 of the actuating link 4 as shown in FIG. 3(*a*) to forcibly move the staple driver 5a upwardly to the staple supply position in the driver guide path 23. When the connecting rod 6 is moved upwardly to this position, the tension of each tension spring 22 becomes greater, and the friction, exerted between the driver 5a and the pusher 24 through the staple S formed by the staple forming member 5b and pushed by the pusher 24, is released, so that the actuating link 4 is moved to the drive initiating position under the bias of the tension springs 22 as shown in FIG. 3(*b*).

As described above, the actuating link 4 is forcibly moved by the connecting rods 6 until the staple driver 5a reaches the pusher 24 disposed in the driver guide path 23, but the further upward movement of the actuating link 4 is effected under the tension of tension springs 22. Therefore, if the staple S is jammed in the driver guide path 23 for some reason, the driver 5a interlockingly engages the jammed staple S, so that there is a large friction therebetween. Therefore, although the staple driver 5a can be upwardly moved by the connecting rods 6 to the predetermined position F in the driver guide path 23, the driver 5a does not move further upwardly but remains in this position since the frictional force between the driver, the jammed staple, and driver guide path 23 is greater than the tension of the tension spring 22. For this reason, subsequent staples S are prevented by the jammed staple S from entering the driver guide path 23. Therefore, even if the motor 15 is energized again to drive the actuating link 4, such subsequent staples S are prevented from entering the driver guide path 23 successively and becoming jammed therein since the staple driver 5a is stopped in the driver guide path 23.

Figure 4:
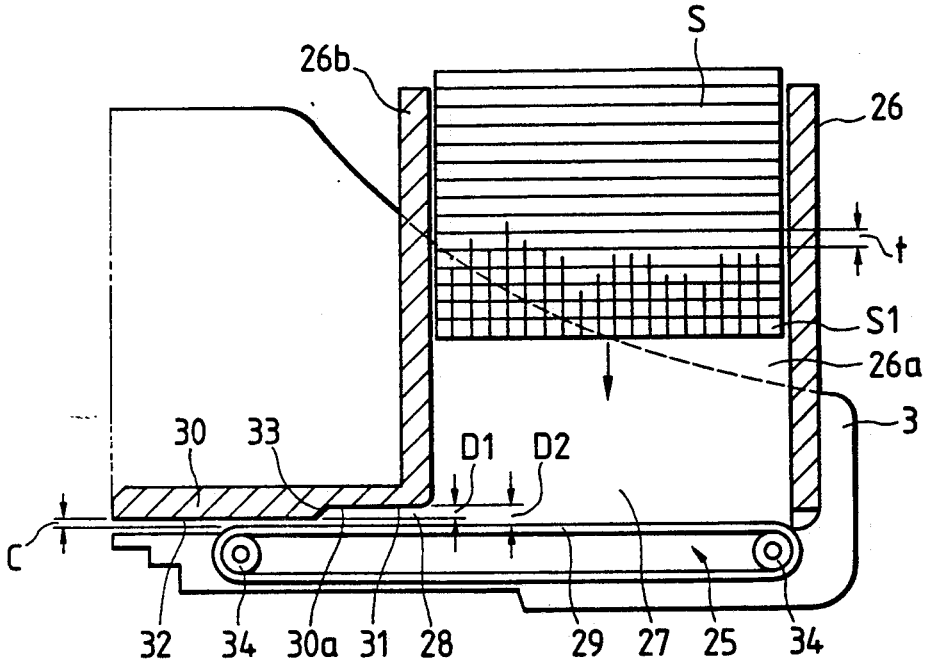
FIG. 4 is a partially cross-sectional, side-elevational view of a staple supply device of the electric stapler.

The magazine 3 is provided with a cartridge mounting portion 25 as shown in FIG. 4, a lowermost one of sheets of staple elements S (staple sheets) is fed from a staple cartridge 26 mounted on the cartridge mounting portion 25. The staple element at the front or leading edge of this staple sheet is formed into a U-shape by the forming member 5b and fed toward the staple driver 5a. The cartridge 26 includes a hollow accommodating portion 26a of a square cross-section for holding or accommodating therein a plurality of staple sheets in a stacked manner. Each staple sheet is composed of a predetermined number of straight staple elements adhesively bonded together in juxtaposed relation. The accommodating portion 26a has an open bottom 27, and a discharge port portion 28 for discharging the lowermost staple sheet S1 from the accommodating portion 26a. A discharge port 28 is formed below a front wall 26b of the accommodating portion 26a defining one side of the open bottom 27. The cartridge 26 also includes a guide portion 30 formed integrally with an extending perpendicularly from the front wall 26b of the accommodating portion 26a in the direction of feed of the staple sheet. The lower face or underside of the guide portion 30 is arranged in two steps, that is, stepped intermediate front and rear ends thereof as at 33 to provide a front guide surface 32 and a rear guide surface 30a which is disposed at a level above the front guide surface 32. The rear guide surface 30a lies flush with a lower edge of the front wall 26b defining the upper surface 31 of the discharge port portion 28. The front and rear guide surfaces 32 and 30a of the guide portion 30 are interconnected by an inclined surface 33 as shown in FIGS. 4 and 5. The rear guide surface 30a of the guide portion 30 extends forwardly from the upper surface 31 of the discharge port portion 28 in coplanar relation thereto and is spaced upwardly from the plane of the front surface 32 a predetermined distance D1 not exceeding a half of the thickness t of the staple (or the staple sheet). The lower face of the guide portion 30 serves to guide the upper face of the staple sheet fed or discharged from the accommodation portion 26a of the cartridge 26 and to hold the staple sheet in contact with a friction surface of an endless belt 29 as later described.

The endless belt 29 extends around rotatable rollers 34 and is provided at a lower portion of the cartridge mounting portion 25. The endless belt 29 is made of rubber so that it has an outer friction surface. The lowermost one S1 of the staple sheets accommodated within the accommodating portion 26a of the staple cartridge 26 is in contact with the friction surface of the endless belt 29 through its open bottom 27.

When the cartridge 26 is attached to the cartridge mounting portion 25, the distance or space D2 between the single planar surface, which is jointly provided by the upper surface 31 of the discharge port portion 28 and the rear guide surface 30a of the guide portion 30, and that portion of the outer friction surface of the endless belt 29 is disposed in facing relation to the cartridge 26 is represented by the following formula:

$$\tfrac{1}{2}t \leqq D2 < t$$

Therefore, a small gap or space C ($C = D2 - D1$)is formed between the front guide surface 32 of the guide portion 30 and that portion of the outer friction surface of the endless belt 29 disposed in facing relation to the cartridge 26.

For explanation purposes, ($D2 = \tfrac{1}{2}t$) is adopted here in this embodiment.

When the staple sheet within the cartridge 26 is to be supplied to the staple forming and driving portion 5, the endless belt 29 is driven for movement around the rollers 34. The lower surface of the lowermost staple sheet S1 received within the cartridge accommodating portion 26a is held in contact with the endless belt 29 through the open bottom 27, and therefore there is exerted a friction therebetween.

Figure 5A:
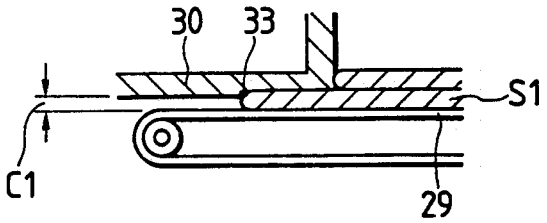
FIGS. 5(*a*) and (*b*) are fragmentary views of the staple supply device, showing the feeding of a sheet of staple elements.

Since the distance D2 between the friction surface of the endless belt 29 and the above single planar surface provided by the upper surface 31 of the discharge port portion 28 and the rear guide surface 30a of the guide portion 30 is set to a half of the staple thickness t ($D2 = \tfrac{1}{2}t$), the force for feeding the staple sheet S1 is very great, so that the sheet S1 is discharged from the discharge port portion 28 as shown in FIG. 5(a).

Figure 5B:
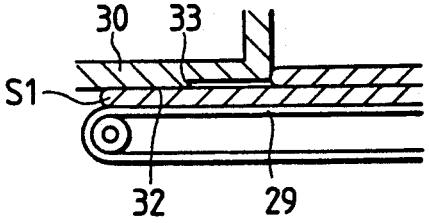

When the staple sheet S1 enters the discharged port portion 28, that is, moves into sliding contact with the upper surface 31 of the discharge port portion 28 and subsequently with the rear guide surface 30a of the guide portion 30, the cartridge 26 is raised or moved upwardly a distance of $\tfrac{1}{2}t$, so that the distance between the front guide surface 32 of the guide portion 30 and the friction surface of the endless belt 29 is increased to a distance C1 ($C1 = \tfrac{1}{2}t + C$). The staple sheet S1 is further advanced toward the staple forming and driving portion 5, passes past the inclined portion 33, and is brought into sliding contact with the front guide surface 32 of the guide portion 30 as shown in FIG. 5(b). At this time, the front guide surface 32 and the friction surface of the endless belt 29 cooperate with each other to provide a essential feed force for feeding the staple sheet S1. In the case of ($\tfrac{1}{2}t \leqq D2 < t$), the staple sheet S1 is fed in a similar manner.

As described above, the lower face of the guide portion 30 is stepped as at 33 nearer to the discharge port portion 28, and the distance between the friction surface of the endless belt 29 and the single planar surface provided by the upper surface 31 of the discharge port portion 28 and the rear guide surface 30a of the guide portion 30 is at least a half of the thickness t of the staple sheet S1. Therefore, the lowermost staple sheet S1 within the cartridge 26 can be discharged therefrom, and in addition a greater feed force is imparted to the staple sheet S1 when the leading edge of the staple sheet S1 passes past the inclined surface 33 of the guide plate 30, so that the staple sheet S1 is further advanced toward the front end of the guide portion 30. Thus, without use of any auxiliary means such as a magnet, a great feed force is obtained since the staple sheet S1 is sufficiently urged against the endless belt by the guide portion 30. Therefore, the staple sheet S1 can be supplied to the predetermined position in a stable manner.

In addition, even if the distance C between the front guide surface 32 of the guide portion 30 and the friction surface of the endless belt 29 is less than a half of the thickness t of the staple sheet S1, a positive feed force is obtained. Therefore, extremely strict dimensional accuracies are not required for the outlet portion, and hence very precise processing is not necessitated, which lowers the cost of the manufacture.

Figure 6:
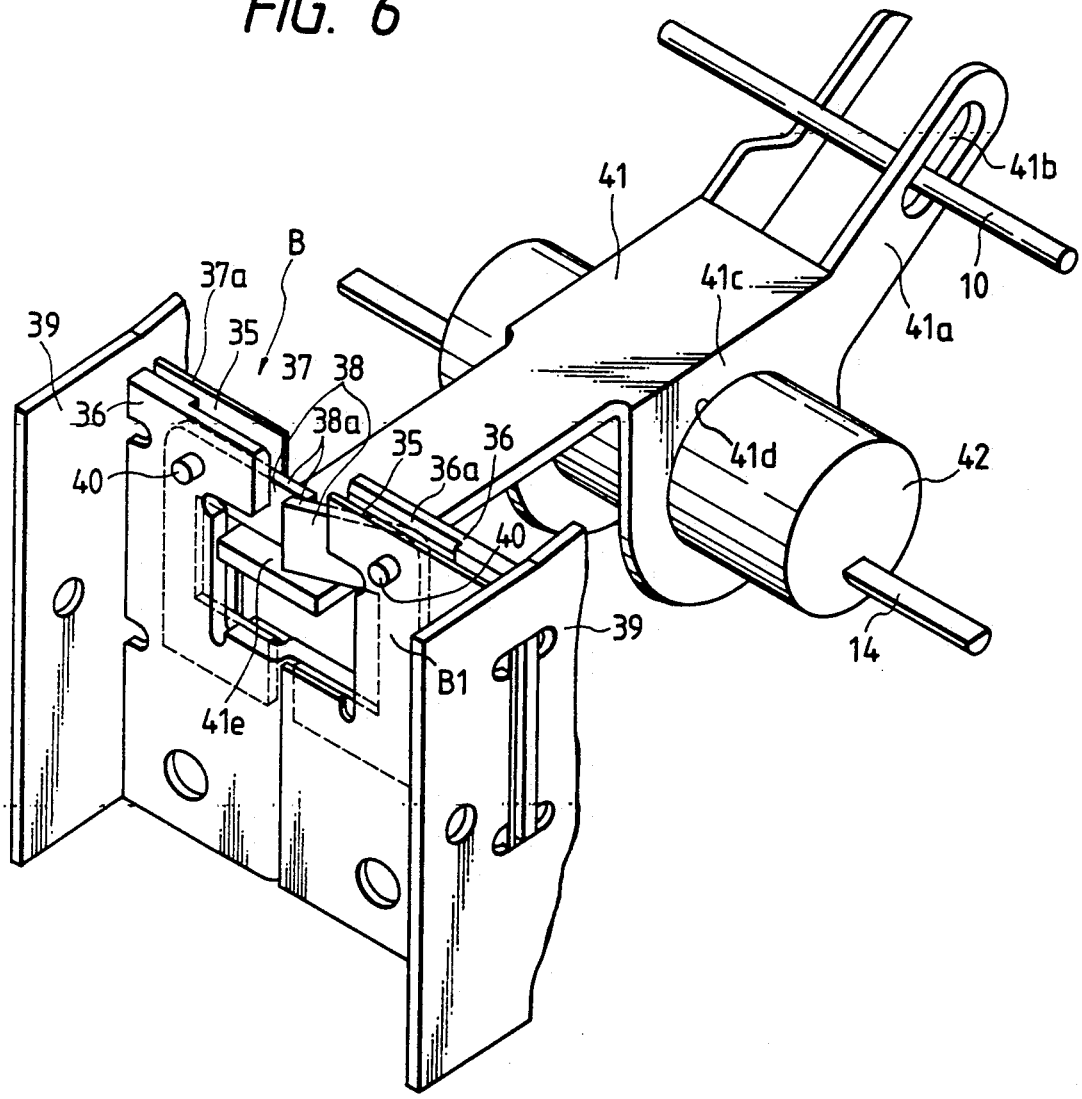
FIG. 6 is a perspective view of a clincher device and its drive means of the electric stapler according to the present invention.

As shown in FIG. 6, a clincher device B comprises a pair of staple folding means B1 arranged in a point-symmetrical manner. Each staple folding means B1 comprises a first stationary wall member 36, a second stationary wall member 37 disposed in parallel spaced, opposed relation to the first stationary wall member 36 to form a folding space 35 of a predetermined width therebetween, and a movable clincher member 38.

The following space 35 formed between the first and second stationary wall members 36 and 37 has a width substantially equal to the width of the stapel S. The two pairs of first and second stationary wall members 36 and 37 are fixedly mounted on side walls 39 of the stapler base 1, respectively. The first stationary wall member 36 has an inclined surface 36a formed on its upper edge and slanting inwardly toward the folding space 35. The movable clincher member 38 is received in the folding space 35 and is pivotally mounted on the first and second stationary wall members 36 and 37 by a pivot pin 40. The upper end face or edge 38*a* of the movable clincher member 38 is flat and is angularly movable about the pivot pin 40 between a stand-by position at a level lower than the lower end of the inclined surface 36*a* of the first stationary wall member 36 and a position near the upper end or edge or second stationary wall member 37. The upper end face serves as an active surface for engagement with the staple leg to urge it against the lower or back face of the article 8.

The movable clincher member 38 is operated by a clincher actuating link 41 which is operatively connected to the drive shaft 14 for being driven. A slot 41*b* is formed through one end 41*a* of the clincher actuating link 41, and the connecting shaft 10 mentioned above is fitter in the slot 41*b*. A cylindrical cam 42 extends through an intermediate portion 41*c* of the link 41 as at 41*d*, the cylindrical cam 42 being fixedly mounted on the drive shaft 14 in eccentric relation thereto. The other end 41*e* of the link 41 is disposed below an upper arm of each of the movable clincher members 38. The clincher actuating link 41 is engaged with the drive shaft 14 through the cylindrical cam 42 in such a manner as to actuate the cylinder members 38 after the legs Sa of the staple extends through the article 8.

Figure 7:
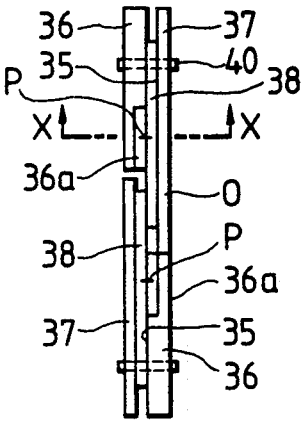
FIG. 7 is a top plan view of the clincher device.

The pair of folding means B1 disposed symmetrically with respect to a point O as shown in FIG. 7 and constitutes the clinch mechanism of the bypass clinch type. The clincher device B is so designed that the distal end of a respective one of the staple legs Sa extending through the article 8 descends to a region P including the boundary between the inclined surface 36*a* of the first stationary wall member 36 and foldind space 35 of each folding means B1.

Figures 8A, 8B, 8C, 8D:
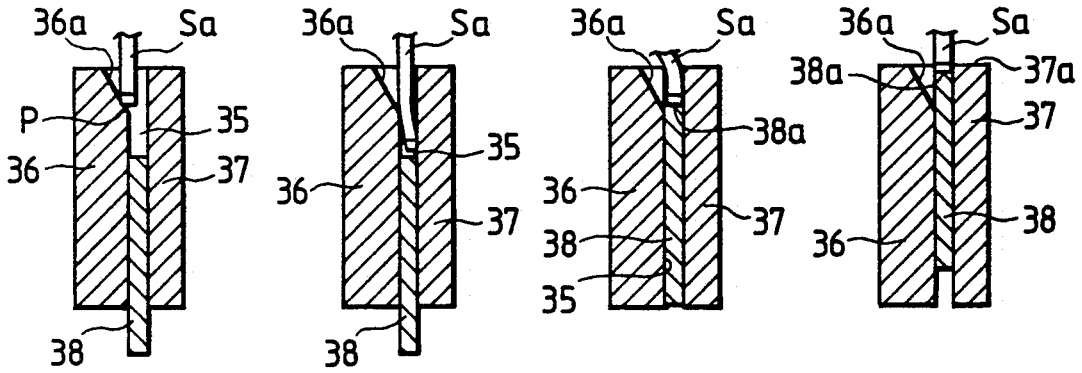
FIGS. 8(*a*), (*b*), (*c*) and (*d*) are cross-sectional views of the clincher device, showing a sequential folding operation of staple legs.

With this staple clinching device B, each staple leg Sa, caused to pass through the article 8 by the stapler driver 5*a*, descends to the above-mentioned region P where the staple leg Sa is brought into engagement with the inclined surface 36*a* of the first stationary wall member 36 as shown in FIG. 8(*a*), and then the staple leg Sa is guided by the inclined surface 36*a* to be introduced into the folding space 35. Subsequently, each of the movable clincher member 38 held in the stand-by position, is pivotally moved about the pivot pin 40 by the clincher actuating link 41, so that the staple leg Sa in the folding space 35 is slidably moved along the raised by the upper end face 38*a* of the movable clincher member 38 to be folded inwardly. At this time, the pair of stapler legs Sa are subject to forces tending to direct them away from each other from the center line of the staple S, that is, forces tending to urge them against the respective second stationary wall members 37. However, since the folding space 35 is substantially equal in width to the staple S, with each second stationary wall member 37 extending to the lower surface of the work 8, each staple leg Sa is prevented by the second stationary wall member .37 from being bent or folded outwardly.

The upper end face 38*a* of the movable clincher member 38 is flat and angularly movable to the direction close to the upper end face 37*a* of the second stationary wall member 37. Therefore, each staple leg Sa is urged until it is brought into ingagement with the lower surface of the article 8, which ensures a positive clinching operation.

Figure 9:
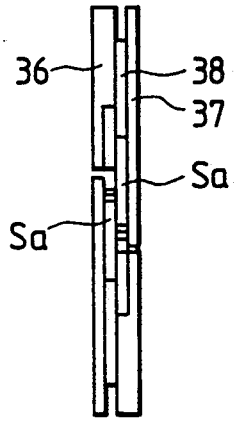
FIG. 9 is a top plan view of the staple folded by the clincher device.
Figure 10A:
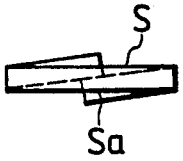
FIGS. 10(*a*) and (*b*) are a top plan view and a bottom view of the staple folded by the clincher device.
Figure 10B:
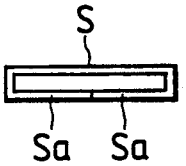

As described above, with the clincher device B according to the invention, the staple S can be folded into the by-pass clinching type as shown in FIGS. 10(*a*) and 10(*b*). In particular, as shown in FIGS. 8 and 9, it is possible to obtain the by-pass clinching under a condition in which the stapler legs are not released from each other.

Although, the invention has been described in connection with what is presently considered to be the most practical and preferred embodiment, it is to be understood that the invention is not limited to the disclosed embodiment but, on the contrary is intended to cover various modifications and equivalent arrangements included within the spirit and scope of the appended claims.

What is claimed is:

1. An electric stapler comprising:

a base;

a magazine pivotally mounted on said base for movement in a vertical plane, said magazine including:

a cartridge mounting portion for mounting a staple cartridge having an accommodating portion for containing a stack of staple sheets;

means defining a staple feed path extending from said accommodating portion to a staple supply portion including an endless belt disposed below said cartridge and having an outer friction surface disposed to engage a staple sheet within said accommodating portion so as to feed it from said accommodating portion to said staple supply portion so that a leading staple in said sheet is in a staple supply position;

means defining a staple driver guide path generally perpendicular to said staple feed path means and passing through said staple supply position;

a staple driver for reciprocal movement along said driver guide path means from an initial position to a stapling position so as to drive a staple fed to said staple supply position, through an article to be stapled;

an actuating link having a first end operatively engaged with said magazine and said staple driver for moving said magazine and said staple driver in a vertical plane, and a second end pivotally mounted on said base;

a drive shaft mounted on said base and operable by a motor for rotation about its axis;

a disc-shaped cam member fixedly mounted on said drive shaft in eccentric relation thereto for rotation therewith;

a connecting rod having at one end an annular portion in which said cam member is rotatably fitted so that rotation of said cam moves said connecting rod in a vertical plane, said connecting rod having a central portion which is connected to a vertically central portion of said actuating link whereby said actuating link is pivotally moved when said rod moves vertically; and clinching means for folding legs of the staple extending through the article against the article.

2. An electric stapler according to claim 1, further comprising resilient urging means for moving said staple driver from said staple supply position to its initial position during its return stroke.

3. An electric stapler according to claim 1, wherein said cartridge includes:

an open bottom in said accommodating portion so that a lowermost one of the stack of staple sheets therein can engage said friction surface of said endless belt;

a discharge port portion formed at a lower end of said accommodating portion for discharging the lowermost staple sheet from said accommodating portion;

an integral guide portion having a lower face extending from said discharge port portion in a direction of feed of the staple sheet along said staple feed path so as to guide an upper surface of the staple sheet and to hold the lower surface of the staple sheet against said friction surface of said endless belt, said lower face of said guide portion being defined into two steps to provide a front guide surface remote from said discharge port portion and a rear guide surface which extends from said discharge port portion and is disposed at a level above said front guide surface, said rear guide surface lying flush with an upper surface of said discharge port portion, said rear guide surface being spaced upwardly from a plane of said front guide surface a distance less than or equal to half of the thickness of the staple sheet, and a distance between that portion of said friction surface of said endless belt disposed in facing relation to said cartridge and a planar surface jointly provided by said upper surface of said discharge port portion and said rear guide surface of said guide portion being at least a half of the thickness of the staple sheet.

4. An electric stapler comprising:

a base;

a magazine pivotally mounted on said base and disposed to move in a vertical plane and including:

a staple supply portion;

a staple housing means for housing a stack of staples, said staple housing means comprising a staple cartridge having an accommodating portion for containing the stack of staples;

means for mounting said staple housing means on said magazine;

means defining a staple feed path extending from said accommodating portion to said staple supply portion including staple feeding means for feeding said staples within said accommodating portion to said staple supply portion so that a leading staple is in a staple supply position, said feeding means comprising an endless belt having an outer friction surface, said feeding means being disposed below said cartridge;

means defining a staple guide path generally perpendicularly to said staple feed path and passing through said staple supply portion;

means for driving a staple in said staple supply position through an article to be stapled so that legs of said staple extend through said article, including a staple driver mounted for reciprocal movement along said staple guide path means from an initial position to a staple supplying position so as to drive the staple, fed to said staple supply portion, through the article to be stapled and means for actuating said staple driver, said actuating means comprising an actuating link having a first end operatively engaged with said magazine and said staple driver for moving said magazine and said staple driver in a vertical plane and a second end pivotally mounted in said base, said actuating means further comprising a drive shaft mounted on said base and operable by a motor for rotation about its axis, a disc-shaped cam member fixedly mounted on said drive shaft eccentric relation thereto for rotation therewith, and a connecting rod having at one end an annular portion in which said cam member is rotatably fitted so as to vertically move said connecting rod, said connecting rod having a central portion which is connected to a portion of said actuating link to pivotally move said link, said cam member being mounted on said shaft so that one rotation of said shaft corresponds to one staple operation;

clinching means for folding legs of the staple extending through the article against the article; and means for preventing a staple from entering the staple supply position when a last driven staple has become jammed during driving comprising tension springs connected between said actuating link and said connecting rods.

5. An electric stapler according to claim 4 wherein said clinching means includes means defining a folding space.

6. An electric stapler according to claim 5 wherein said means defining a folding space comprises a first stationary wall member and a second stationary wall member disposed in parallel spaced opposed relation to said first stationary wall member thereby forming a folding space therebetween for receiving the legs of the staple.

7. An electric stapler as in claim 6 wherein said clincher further comprises a clincher member movable relative to said first and second wall members for folding the staple legs disposed in said folding space.

* * * * *